US008684370B2

(12) United States Patent
Baumann

(10) Patent No.: US 8,684,370 B2
(45) Date of Patent: Apr. 1, 2014

(54) SKATEBOARD TRUCK

(76) Inventor: Fredrick Boyd Baumann, Glendora, CA (US)

( * ) Notice: Subject to any disclaimer, the term of this patent is extended or adjusted under 35 U.S.C. 154(b) by 0 days.

(21) Appl. No.: 13/556,846

(22) Filed: Jul. 24, 2012

(65) Prior Publication Data

US 2014/0027989 A1 Jan. 30, 2014

(51) Int. Cl.
*A63C 1/00* (2006.01)

(52) U.S. Cl.
USPC ..... 280/11.27; 280/11.28; 280/87.042

(58) Field of Classification Search
USPC ..... 280/11.27, 11.28, 87.041, 87.042
See application file for complete search history.

(56) References Cited

U.S. PATENT DOCUMENTS 6,182,987 B1 * 2/2001 Bryant ..... 280/87.042
6,793,224 B2 * 9/2004 Stratton ..... 280/87.042
7,104,558 B1 * 9/2006 Saldana ..... 280/87.042
7,150,460 B2 * 12/2006 Williams ..... 280/87.042
7,287,762 B2 * 10/2007 Stratton ..... 280/11.27
8,328,206 B2 * 12/2012 Williams, Jr. ..... 280/11.28
2002/0125670 A1 * 9/2002 Stratton ..... 280/87.041
2002/0167415 A1 * 11/2002 Rains et al. ..... 340/665

* cited by examiner

*Primary Examiner* — Hau Phan
(74) *Attorney, Agent, or Firm* — Kenneth L. Green

(57) ABSTRACT

A skateboard truck maintains truck geometry. The truck includes a support pin including a cylindrical end slideably engaging a cylindrical passage in a base plate, and a ball end residing in a socket in a hanger. A support pin bushing under the cylindrical end is compressible and both carries some of a rider's weight and holds the ball end in the socket providing a second pivot to the truck. The second pivot eliminates horizontal play of the hanger thereby facilitating consistent compression of the kingpin bushings and improved stability of the skateboard. Support pin travel allows off-center kingpin bushing compression for steering and improves shock absorption. Eliminating horizontal play allows lengthened kingpin bushings and use of the entire height of the kingpin bushings. The combination of kingpin bushing preload, and weight carried by the support pin, tends to equalize the compression of the top and bottom kingpin bushings improving stability.

18 Claims, 6 Drawing Sheets

SKATEBOARD TRUCK

BACKGROUND OF THE INVENTION

The present invention relates to skateboards and in particular to a skateboard truck providing improved stability and ride.

Riding skateboards is a very popular recreational activity among young people. Participants in extreme sports events perform acrobatic maneuvers involving jumps, twists, and turns requiring great skill and athleticism. Other events involve high speed runs down hills where speeds have reach 80 miles per hour.

The skateboards are supported by wheels connected to the skateboard by trucks. Known trucks include a base plate which is attached to a skateboard deck and a hanger connected to the base plate and carrying wheels. The hanger includes a pivot which engages the base plate at an angle and a kingpin which sandwiches a ring portion of the hanger between kingpin bushings. The kingpin bushings allow limited motion of the hanger with respect to the base plate, and the angled pivot couples rolling the skateboard deck along a deck centerline into turning the hanger left and right to steer the skateboard.

Unfortunately, the kingpin bushings allow horizontal motion of the hanger with respect to the base plate which results in altering the geometry of the truck causing instabilities and inconsistent handling, especially at high speeds and in radical maneuvers. Additionally, the kingpin bushings carry most of the riders weight resulting in transfer of compression from the upper kingpin bushing to the lower kingpin bushing. When additional weight is applied to the truck, the transfer of compression changes, and the handling characteristics of the board change because the ride height and hanger pivot angle are determined by the compressed bottom bushing length, resulting in unpredictable turning. The maximum length of the kingpin bushings is also limited by the change in geometry experienced when the kingpin bushings are compressed, limiting a rider's ability to turn.

Thus a need is present for a more stable skateboard truck.

BRIEF SUMMARY OF THE INVENTION

The present invention addresses the above and other needs by providing a skateboard truck which maintains truck geometry. The truck includes a support pin including a cylindrical end slideably engaging a cylindrical passage in a base plate, and a ball end residing in a socket in a hanger. A support pin bushing under the cylindrical end is compressible and both carries some of a rider's weight and holds the ball end in the socket providing a second pivot to the truck. The second pivot eliminates horizontal play of the hanger thereby facilitating consistent compression of the kingpin bushings and improved stability of the skateboard. Support pin travel allows off-center kingpin bushing compression for steering and improves shock absorption. Eliminating horizontal play allows lengthened kingpin bushings and use of the entire height of the kingpin bushings. The combination of kingpin bushing preload, and weight carried by the support pin, tends to equalize the compression of the top and bottom kingpin bushings improving stability.

In accordance with one aspect of the invention, there is provided an improved skateboard truck having a support pin providing a second pivot. The additional pivot provides horizontal stability and maintains consistent truck geometry in turns.

In accordance with one aspect of the invention, there is provided an improved skateboard truck having a support pin carrying part of the rider's weight. The kingpin bushings generally carry most of the rider's weight. During a turn, additional force is applied to the kingpin bushings compressing the lower kingpin bushing. Such compression alters the truck geometry and reduces predictability. The support pin carries some of the weight otherwise carried by the lower kingpin bushing, thereby retaining truck geometry and predictable handling. Further, due to maintaining consistent the truck geometry, somewhat longer kingpin bushings may be used which provide a better feel of resistance to the rider while turning and shock absorption when landing a jump.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

To provide better views of the truck according to the present invention, the truck is shown inverted.

Figure 1A:
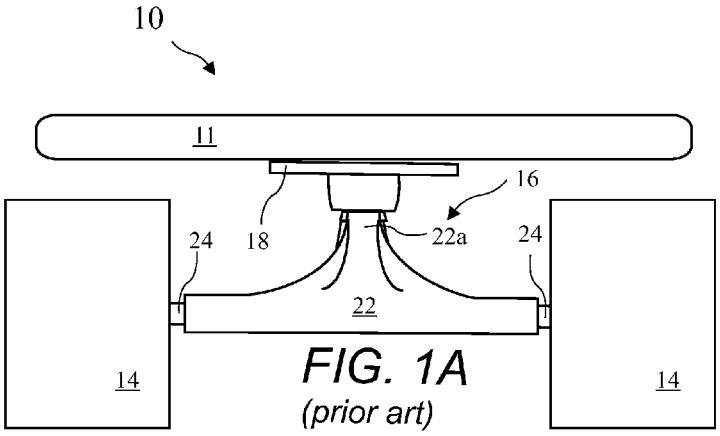
FIG. 1A (prior art)
FIG. 1A is a front view of a known truck.
Figure 1B:
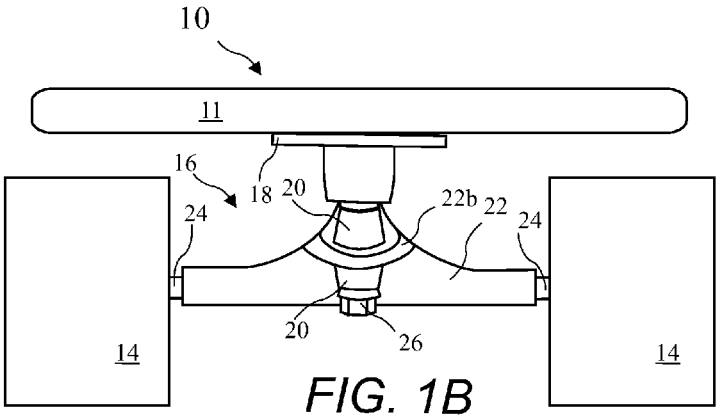
FIG. 1B (prior art)
FIG. 1B is a rear view of the known truck.
Figure 1D:
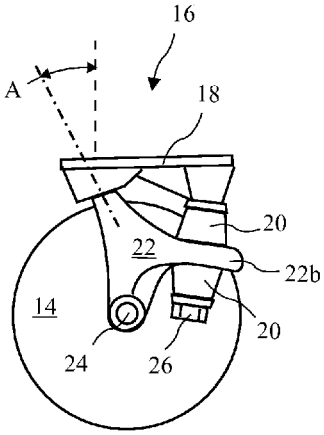
FIG. 1D (prior art)
FIG. 1D is a side view of the known truck.
Figure 1C:
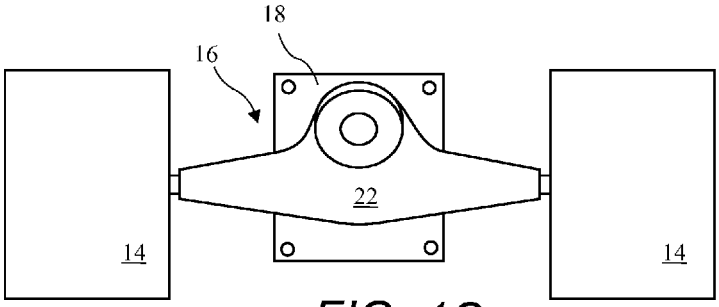
FIG. 1C (prior art)
FIG. 1C is a bottom view of the known truck.

A front view of a prior art skateboard 10 having a skateboard truck 16 attached to a skateboard deck 11 is shown in FIG. 1A, a rearview of the skateboard 10 is shown in FIG. 1B, a bottom view of the truck 16 is shown in FIG. 1C, and is a side view of the truck 16 is shown in FIG. 1D. The truck 16 includes a base plate 18 attached to the deck 11, a hanger 22 pivotally engaging the base plate 18 at a pivot end 22*a*, axles 24 reaching laterally from the hanger 22 for mounting the wheels 14, and a kingpin 26 holding the hanger 22 in place. Two kingpin bushings 20 reside on the kingpin 26 and sandwich a ring portion 22*b* of the hanger 22. The kingpin 26 may be tightened or loosened (or harder or softer bushings may be selected) to adjust the turning responsiveness of the skateboard 10. The pivot end 22*a* of the hanger 22 is tilted at an angle A and thereby couples leaning the deck 11 to the left or right with turning the hanger 16 to steer the skateboard 10 to the left or right.

Figure 3A:
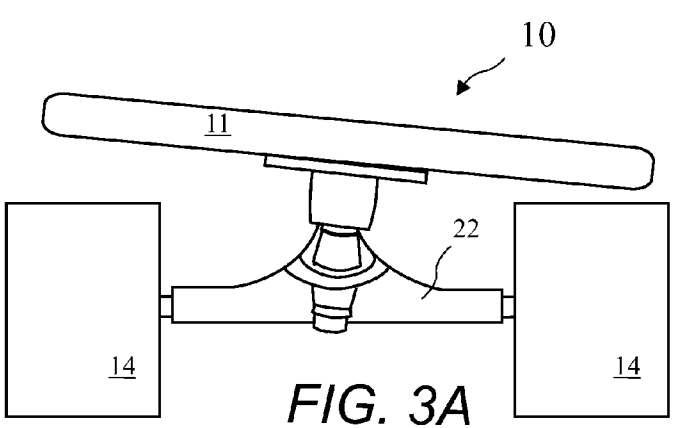
FIG. 3A (prior art)
FIG. 3A shows a skateboard deck leaned to a right side to turn.
Figure 3B:
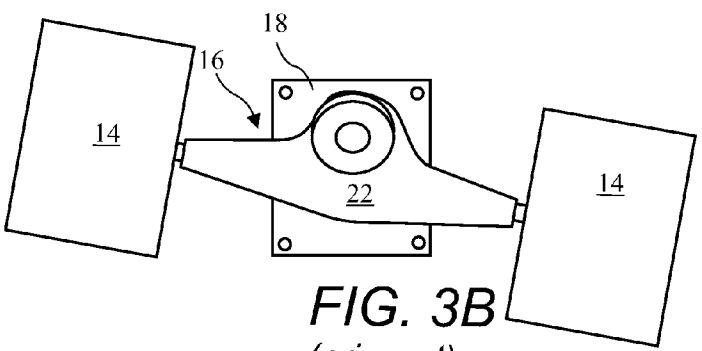
FIG. 3B (prior art)
FIG. 3B shows the known skateboard truck reacting to leaning the deck to turn right.
Figure 2A:
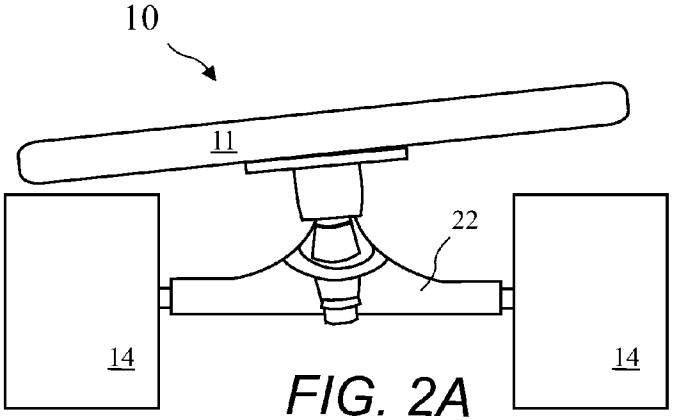
FIG. 2A (prior art)
FIG. 2A shows a skateboard deck leaned to a left side to turn.
Figure 2B:
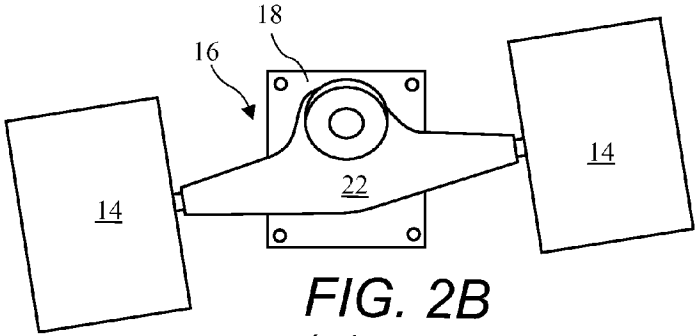
FIG. 2B (prior art)
FIG. 2B shows the known skateboard truck reacting to leaning the deck to turn left.

The skateboard deck 11 is shown leaned to a left side to turn left in FIG. 2A and skateboard truck 16 is shown reacting to the leaned deck to turn left in FIG. 2B. The skateboard deck 11 is shown leaned to a right side to turn right in FIG. 3A and skateboard truck reacting to the leaned deck to turn right in FIG. 3B. The skateboard 10 is thus turned to the left or right by leaning the deck 11 to the left or right respectively, the leaning coupled to the turning by the trucks 16.

Figure 4A:
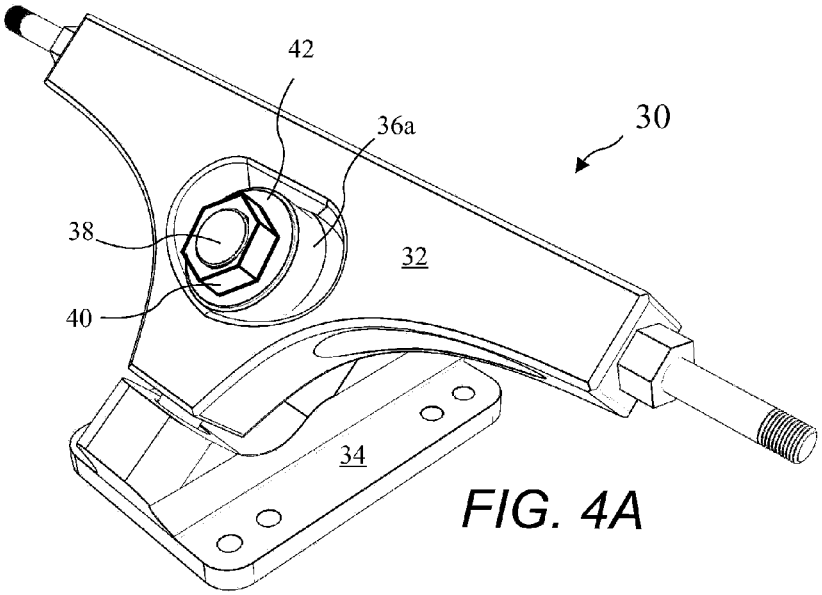
FIG. 4A shows a first perspective view of a skateboard truck according to the present invention.
Figure 4B:
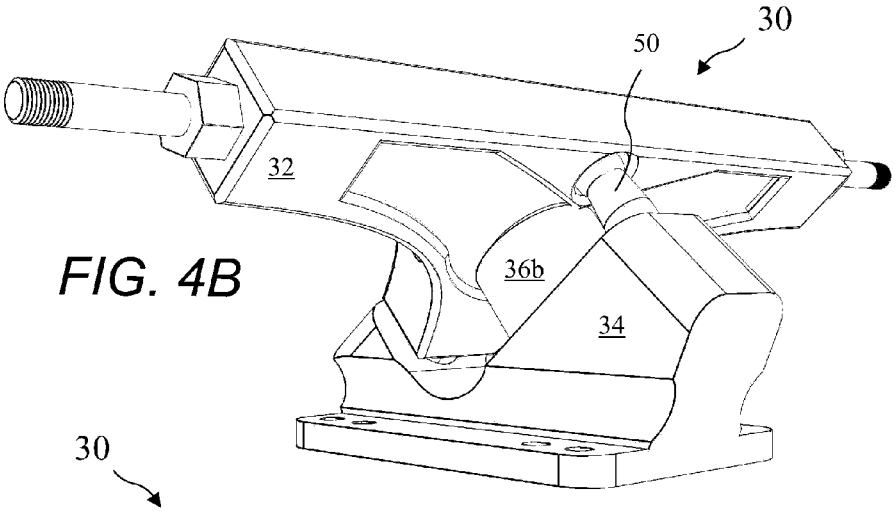
FIG. 4B shows a second perspective view of the skateboard truck according to the present invention.
Figure 4C:
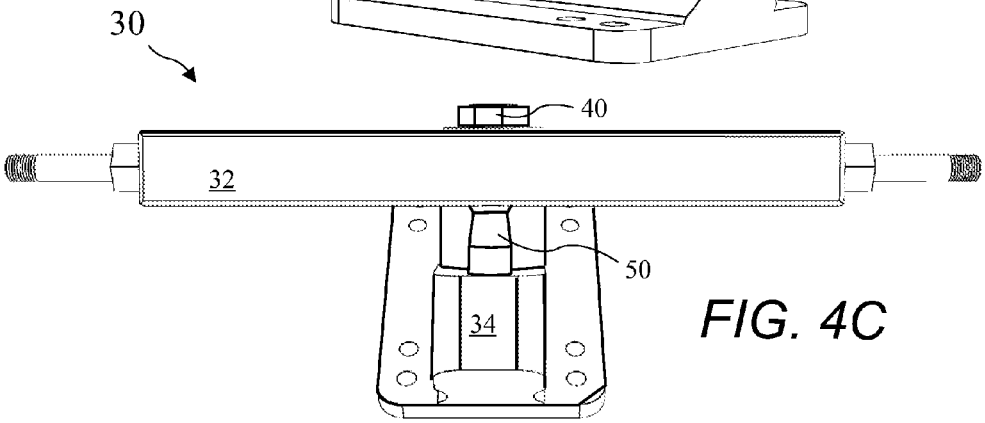
FIG. 4C shows a front perspective view of the skateboard truck according to the present invention.

A first perspective view of a skateboard truck 30 according to the present invention is shown in FIG. 4A, a second perspective view of the skateboard truck 30 is shown in FIG. 4B, and front perspective view of the skateboard truck 30 is shown in FIG. 4C. The truck 30 functions in a manner similar to the truck 16, but includes a support pin 50 which adds significant stability to the truck 30, maintains the geometry of the truck 30, and softens the ride of the truck 30.

Figure 5B:
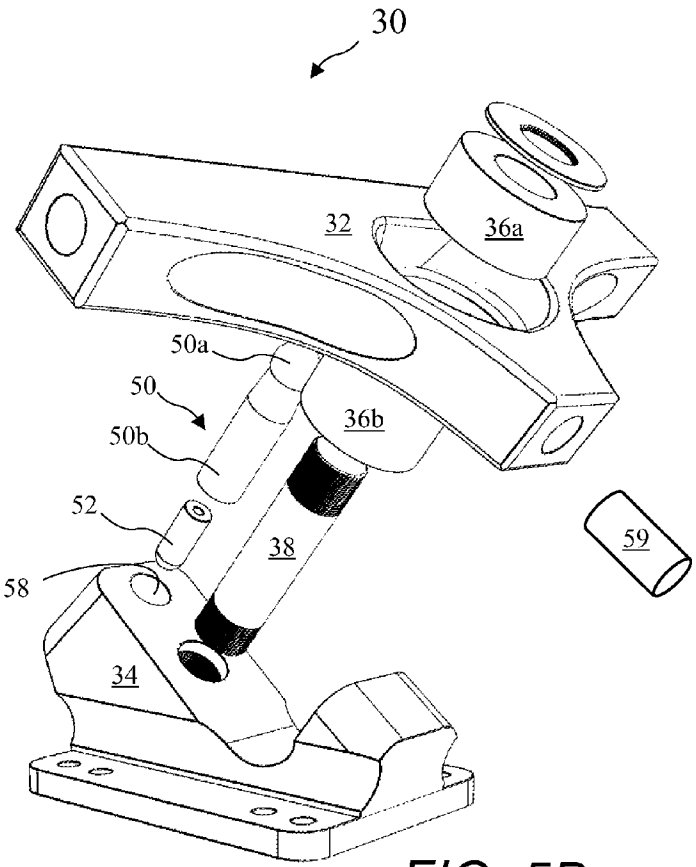
FIG. 5B shows a second exploded view of the skateboard truck according to the present invention.
Figure 5A:
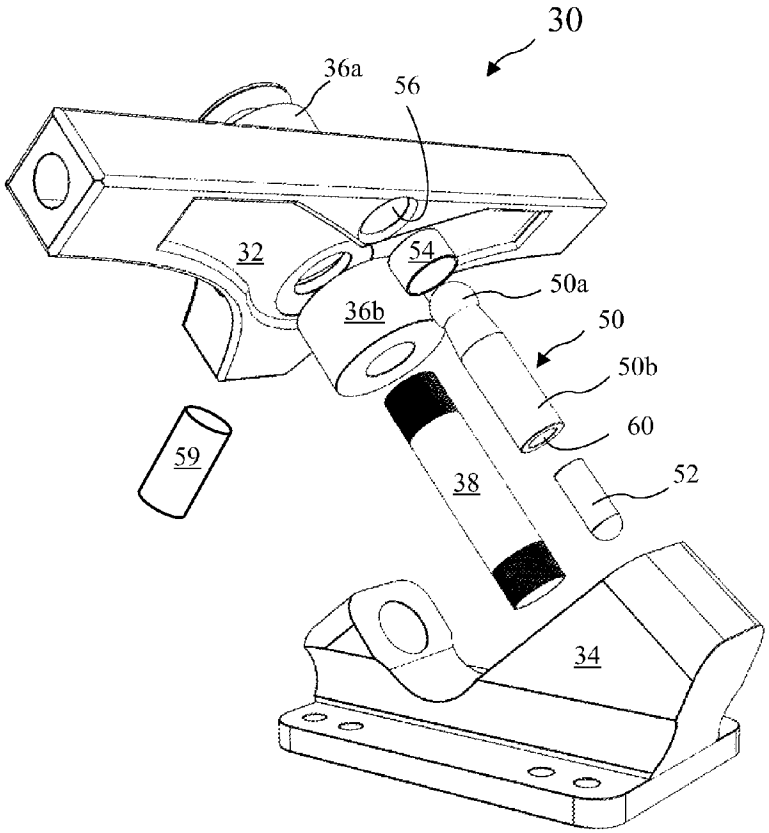
FIG. 5A shows a first exploded view of the skateboard truck according to the present invention.

A first exploded view of the skateboard truck 30 is shown in FIG. 5A and a second exploded view of the skateboard truck 30 is shown in FIG. 5B. The skateboard truck 30 includes a pivot 59 and a king pin 38 similar to prior art skateboard trucks. The pivot 59 is preferably a cylindrical metal member having one end press fit into the hanger 22 and an opposite end residing in a rubber tube in the baseplate, thus allowing slight movement relative to the baseplate. As with prior art skateboard trucks, the pivot 59 is angled to couple leaning the deck to the left or right with turning the hanger 32 to steer the skateboard. An upper (or roadside) king pin bushing 36*a* and a lower (or deckside) king pin bushing 36*b* are carried by the kingpin 38 and sandwich the hanger 32.

The support pin 50 has a hollow cylindrical end 50*b* which resides in a cylindrical support pin passage 58 in the base plate 34, and a ball end 50*a* which cooperated with a support pin seat (or support cup) 54 which resides in a recess 56 in the hanger 32. The support cup 54 is preferably made from polyoxymethylene plastic (for example Delrin® made by Dupont in Parkersburg, West Va., or a similar material and is removable. The ball end 50*a* is free to pivot in the seat 54 and remains in the seat 54 during normal riding to provide a second pivot for the hanger. The provision of a second pivot provide stability to the truck 30 and maintains the geometry of the truck 30.

Preferably, the support pin 50 is parallel with the kingpin 38, providing a stronger design. If the support pin 50 is not parallel to the kingpin 38, when the support pin 50 travels up and down in the base plate 34 during riding, friction and force are generated on one side of the support pin ball end 50*a*. The embodiment described herein maintains a parallel relationship between the kingpin 38 and support pin 50 for up to approximately 45 degrees of skateboard deck roll.

The kingpin bushings 36*a* and 36*b* carry the majority of the rider's weight. On conventional trucks, as a rider articulates (i.e., leans) the deck to turn, weight transfers to the lower kingpin bushing 36*b* and distorts the geometry of the truck because the ride height and pivot angle are determined by the compressed lower kingpin bushing 36*b* length, and the force of the bushing seat is pushing on the upper bushing 36*a* and kingpin washer/nut. The kingpin nut 40 is preferably a locknut having a plastic locking portion, and is generally tightened to at least partially engage the plastic locking portion with threads on the kingpin stud 38.

The support pin 50 holds the truck geometry during the articulation by keeping the hanger 32, kingpin bushings 36*a* and 36*b*, and base aligned 34. The support pin 50 also carries some of the force otherwise carried by the lower kingpin bushing 36*b* during articulation, allowing the truck 30 to retain a substantial amount of pivot angle (or ride height), due to the support pin 50 providing resistance to compression of the lower kingpin bushing 36*b*. The redistribution of force to the support pin 50 allows consistent side to side compression on the kingpin bushings 36*a* and 36*b* and consistent handling. The support pin 50 preferably has about 0.13 inches of travel.

Kingpin bushings are characterized by size and compressibility. Compressibility is measured in the unit of durometers, where the higher the durometer, the harder the material. For example, car tires have a durometer of around 40 a while a golf ball is around 100 a. Conventional kingpin bushings range from 70 a to 95 a. Preferred kingpin bushings 36*a* and 36*b* appear harder to a rider as compared to conventional trucks because of the added resistance to compression from the support pin 50 on the hangar 32. Since the hangar 32 experience less compression (i.e., moving closer to the base plate 34 and reducing ride height) due to the support pin 50, more of the leaning of the deck is transferred into the turning instead of reducing ride height. This creates a more consistent and steady turn compared to conventional trucks which allows you to use a harder kingpin bushings 36*a* and 36*b*.

Different size kingpin bushings 36*a* and 36*b* may be used to create desired feelings of rider articulation throughout a turn. The two most accepted kingpin bushing designs are cone bushings and barrel bushings. Cone bushings are easier to articulate with a matching durometer in direct comparison to barrel bushings. Barrel bushings provide more urethane cushion compared to cone bushings and are the most widely used bushing in downhill skateboarding, while in typical street skating, cone bushings are predominant in the market. The trucks 30 preferably include slightly taller barrel bushings 36*a* and 36*b*, for example, 0.75 inches in height, compared to the conventional height of 0.65 inches. The slightly taller kingpin bushings 36*a* and 36*b* give a better feel of resistance while articulating as well as more shock absorption when the rider lands at the end of a jump.

Figure 6:
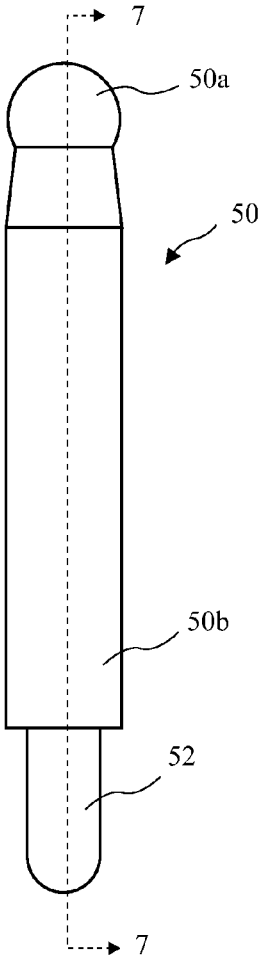
FIG. 6 shows a side view of a support pin and support pin bushing according to the present invention.
Figure 7:
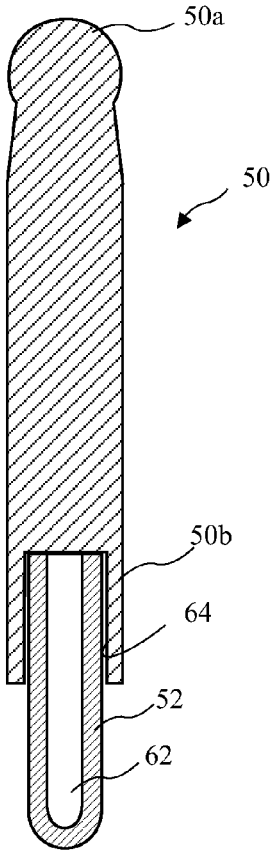
FIG. 7 is a cross-sectional view of the support pin and the support pin bushing according to the present invention taken along line 7-7 of FIG. 6.

A side view of a support pin 50 and support pin bushing 52 according to the present invention is shown in FIG. 6 and a cross-sectional view of the support pin 50 and the support pin bushing 52 is shown in FIG. 7. The support pin 50 is preferably rigid and more preferably a rigid metal material. The support pin bushing 52 is compressible allowing the support pin 50 to be pressed into the support pin passage 58 when axial force is applied to the support pin 50, and resiliently return to an original position when the force is removed.

Figure 8B:
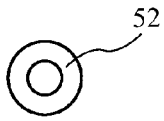
FIG. 8B is a top view of the support pin bushing according to the present invention.
Figure 8A:
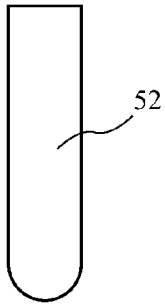
FIG. 8A is a side view of the support pin bushing according to the present invention.

A side view of the support pin bushing 52 according to the present invention is shown in FIG. 8A and a top view of the support pin bushing 52 is shown in FIG. 8B. A support pin bushing 52 resides partially in a bushing cavity 60 (see FIG. 5A) in the hollow cylindrical end 50*b*. The support pin bushing 52 is preferably a hollow rubber tube with one closed hemispherical end. Preferably, the support pin bushing 52 is hollow to allow some pneumatic resistance to support pin bushing compression. Initially, as the support pin 50 receives weight from the rider, and the support pin bushing 52 compresses as the support pin 50 advances into the base plate 34. As pressure increases inside the support pin bushing 52, the support pin bushing 52 expand against inside walls 64 of the support pin passage 60. After the support pin bushing 52 has expanded to the walls 64, the mechanical characteristics of the support pin bushing 52 allow the support pin bushing 52 to bottom out at the bottom of the support pin passage 60 and resist further compression.

The support pin bushing 52 is preferably about 0.62 inches long, has an outside diameter of about 0.26 inches, and an inside diameter of about 0.1 inches. The support pin bushing 52 is preferably made of rubber having a hardness rating of 65 durometers (i.e., 65 a).

The easier initial compression of the hollow support pin bushing 52, followed by greater resistance to compression, provides a consistent feeling of resistance while articulating the trucks. This overall effect provides a non-ridged suspension system for the skateboard truck 30. Various springs, solid plastic, and solid rubber were tested, but the hollow characteristics of the rubber support pin bushing 52 provided the desired result for the support pin 50.

Figure 9A:
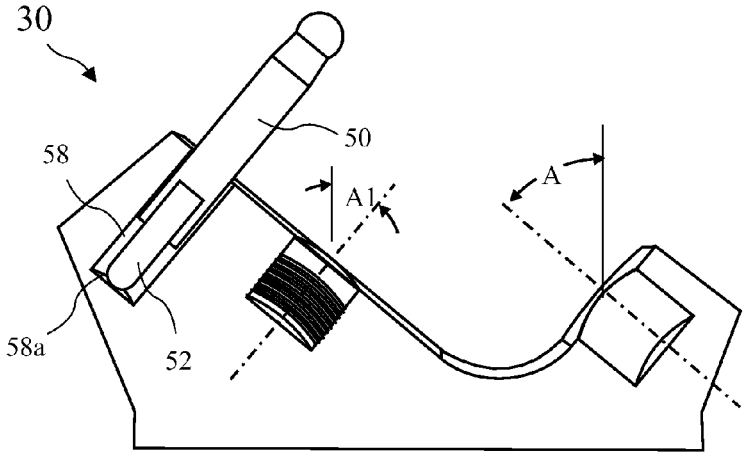
FIG. 9A shown a side view of the truck according to the present invention with no compression of the support pin bushing.
Figure 9B:
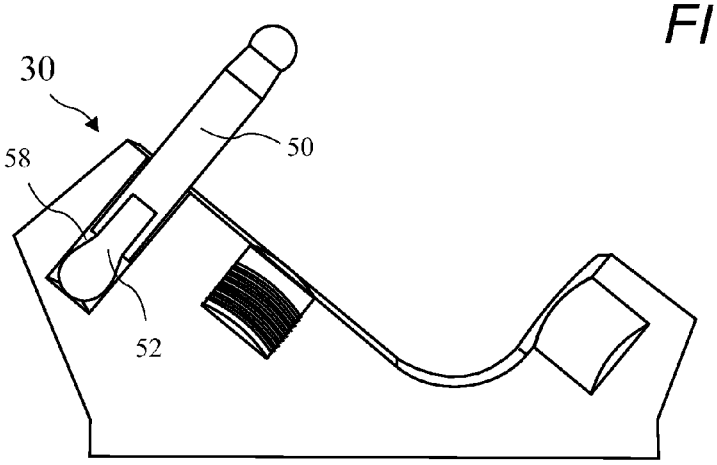
FIG. 9B shown a side view of the truck according to the present invention with partial compression of the support pin bushing.
Figure 9C:
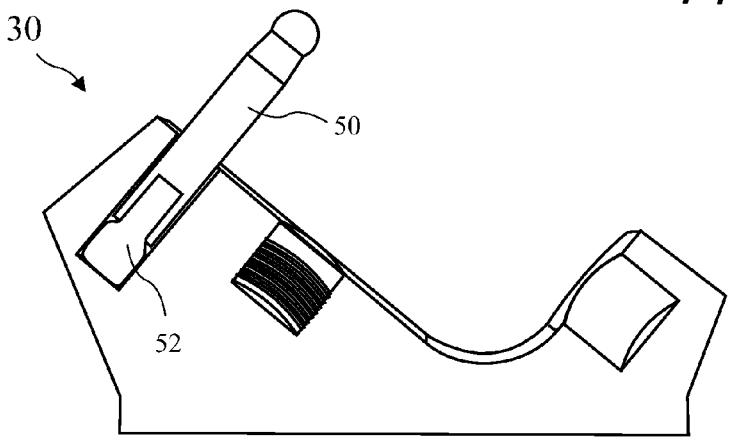
FIG. 9C shown a side view of the truck according to the present invention with full compression of the support pin bushing.

A side view of the truck 30 showing no compression of the support pin bushing 52 against a support pin passage base 58*a* is shown in FIG. 9A, a side view of the truck 30 with partial compression of the support pin bushing 52 is shown in FIG. 9B, and a side view of the truck 30 with full compression of the support pin bushing 52 is shown in FIG. 9C. The support pin 50 can slide axially within the support pin passage 58, but cannot pivot (i.e., cannot move side to side or front to rear) within the support pin passage 58. The support pin bushing 52 transitions from a cylindrical shape to a bulb forming in the support pin passage 58 below the support pin bushing 52. The kingpin is at an angle A1 typically selected from 20, 20, 490, and 45 degree.

The compressibility of the support pin 50 and support pin bushing 52 were determined through testing different bushings to obtain the desired characteristics of the truck. The resulting compressibility of the support pin 50 and support pin bushing 52 may be characterized by a set of measurements:

| force on support pin (in pounds) | support pin compression (in inches) |
|---|---|
| 0 | 0 |
| 2 | 0.03 |
| 4.5 | 0.06 |
| 9 | 0.09 |
| 18 | 0.12 |
| 26 | 0.13 |
| 42 | 0.135 |
| 95 | 0.137 |

where all values are approximate. The compression is non-linear and has a compression of about 0.006 inches per pound of force up to about 20 pounds of force, and about 0.0001 inches per pound of force beyond about 20 pounds of force.

While the invention herein disclosed has been described by means of specific embodiments and applications thereof, numerous modifications and variations could be made thereto by those skilled in the art without departing from the scope of the invention set forth in the claims.

I claim:

1. A stable skateboard truck comprising:

a base plate fixedly attachable to a skateboard deck;

a hanger;

a pivot pivotally connecting the hanger to the base plate and residing at a pivot angle A for coupling leaning a skateboard into turning the hanger;

a kingpin angled at a kingpin angle A1 opposite the pivot angle A;

upper and lower kingpin bushings residing on the kingpin and sandwiching the hanger and resisting lean of the skateboard; and a support pin held pivotally fixed with respect to the baseplate and parallel to the kingpin, and providing a second pivot for the hanger, thereby maintaining the geometry of the truck, wherein the kingpin resides between the support pin and the pivot.

2. The skateboard truck of claim 1, wherein the support pin has a cylindrical end residing in a cylindrical support pin passage in the base plate.

3. The skateboard truck of claim 2, wherein the support pin has a spherical end opposite the cylindrical end, and the spherical end engages a hemispherical seat of the hanger providing a second pivot.

4. The skateboard truck of claim 3, wherein the support pin slideably resides in the support pin passage.

5. The skateboard truck of claim 4, wherein the support pin is pressable into the support pin passage when axial force is applied to the support pin, and resiliently return to an original position when the force is removed.

6. The skateboard truck of claim 5, wherein the support pin presses into the support pin passage in response to force:

approximately 0.03 inches under approximately 2 pounds of force;

approximately 0.06 inches under approximately 4.5 pounds of force;

approximately 0.09 inches under approximately 9 pounds of force;

approximately 0.12 inches under approximately 18 pounds of force;

approximately 0.13 inches under approximately 26 pounds of force;

approximately 0.135 inches under approximately 42 pounds of force; and approximately 0.137 inches under approximately 95 pounds of force.

7. The skateboard truck of claim 5, wherein;

the support pin is rigid; and a compressible support pin bushing resides between the cylindrical end of the support pin and a base of the support pin passage.

8. The skateboard truck of claim 7 the cylindrical end of the support pin is hollow and the support pin bushing resides partially inside the hollow cylindrical end.

9. The skateboard truck of claim 8, wherein a cylindrical portion of the support pin bushing resides partially inside the hollow cylindrical end of the support pin and a spherical end of the support pin bushing resides in the bottom of the support pin passage in contact with the base of the support pin passage.

10. The skateboard truck of claim 9, wherein the support pin bushing is hollow.

11. The skateboard truck of claim 10, wherein the spherical end of the support pin bushing is distorted to expand outwardly to fill the support pin passage when the support pin is pushed into the support pin passage.

12. A stable skateboard truck comprising:

a base plate fixedly attachable to a skateboard deck;

a hanger;

a pivot pivotally connecting the hanger to the base plate and residing at a pivot angle A for coupling leaning a skateboard into turning the hanger;

a kingpin angled at a kingpin angle A1 opposite the pivot angle A;

upper and lower kingpin bushings residing on the kingpin and sandwiching the hanger and resisting lean of the skateboard; and a support pin held pivotally fixed with respect to the baseplate and providing a second pivot for the hanger, thereby maintaining the geometry of the truck, wherein:

the support pin is a rigid support pin comprising:

a cylindrical end residing axially slidable in a support pin passage in the base plate; and a spherical end opposite the cylindrical end engaging a hemispherical seat in the hanger providing the second pivot for the hanger; and a support pin bushing resides between support pin and a base of the support pin passage.

13. The skateboard truck of claim 12, wherein the support pin bushing is made of rubber.

14. The skateboard truck of claim 13, wherein the support pin bushing has a harness of about 65 a.

15. The skateboard truck of claim 13, wherein the support pin bushing is about 0.62 inches long, has an outside diameter of about 0.26 inches, and an inside diameter of about 0.1 inches.

16. The skateboard truck of claim 13, wherein the support pin bushing compression is non-linear and has a compression of about 0.006 inches per pound of force up to about 20 pounds of force, and about 0.0001 inches per pound of force beyond about 20 pounds of force.

17. A stable skateboard truck comprising:

a base plate fixedly attachable to a skateboard deck;

a hanger;

a hanger pivot pivotally connecting the hanger to the base plate and residing at a pivot angle A for coupling leaning a skateboard into turning the hanger;

a kingpin angled at a kingpin angle A1 opposite the pivot angle A;

upper and lower kingpin bushings residing on the kingpin and sandwiching the hanger and resisting lean of the skateboard;

a rigid support pin residing next to the kingpin on a side opposite to the hanger pivot, the support pin comprising:

a hollow cylindrical end slideably residing in a cylindrical support pin passage allowing axial motion; and a spherical end opposite the cylindrical end and seated in a spherical seat of the hanger providing a second pivot for the hanger, thereby maintaining the geometry of the truck; and a hollow rubber support pin bushing partially residing in the hollow cylindrical end of the support pin and abutting a base of the support pin passage, and providing resistance to pushing the support pin deeper into the support pin passage, and firmly seating the spherical end of the support pin in the spherical seat of the hanger, the support pin bushing compressible to allow movement of the hanger.

18. A stable skateboard truck comprising:

a base plate fixedly attachable to a skateboard deck;

a hanger;

a hanger pivot pivotally connecting the hanger to the base plate and residing at a pivot angle A for coupling leaning a skateboard into turning the hanger;

a kingpin angled at a kingpin angle A1 opposite the pivot angle A;

upper and lower kingpin bushings residing on the kingpin and sandwiching the hanger and resisting lean of the skateboard;

a rigid support pin residing next to the kingpin on a side opposite to the hanger pivot, the support pin comprising:

a cylindrical end slideably residing in a cylindrical support pin passage allowing axial motion; and a spherical end opposite the cylindrical end and seated in a spherical seat of the hanger providing a second pivot for the hanger, thereby maintaining the geometry of the truck; and a support pin bushing in compression between the support pin and a base of the support pin passage, and providing resistance to pushing the support pin deeper into the support pin passage, and firmly seating the spherical end of the support pin in the spherical seat of the hanger, the support pin bushing compressible to allow movement of the hanger, the compression of support pin bushing fitting generally to data points comprising:

0.03 inches of compression under 2 pounds of force;

0.06 inches of compression under 4.5 pounds of force;

0.09 inches of compression under 9 pounds of force;

0.12 inches of compression under 18 pounds of force;

0.13 inches of compression under 26 pounds of force;

0.135 inches of compression under 42 pounds of force; and 0.137 inches of compression under 95 pounds of force.

* * * * *